US006167894B1

(12) United States Patent
Lin

(10) Patent No.: US 6,167,894 B1
(45) Date of Patent: Jan. 2, 2001

(54) UMBRELLA FRAME

(76) Inventor: Yao-Chin Lin, No. 21, Alley 24, Lane 273, Sec. 3 Tungmen Rd., Tainan (TW)

( * ) Notice: Under 35 U.S.C. 154(b), the term of this patent shall be extended for 0 days.

(21) Appl. No.: 09/347,937

(22) Filed: Jul. 6, 1999

(30) Foreign Application Priority Data

May 24, 1999 (TW) ..... 88208333

(51) Int. Cl.[7] ..... A45B 25/00
(52) U.S. Cl. ..... 135/15.1
(58) Field of Search ..... 135/15.1, 22, 23, 135/28, 37, 38, 26

(56) References Cited

U.S. PATENT DOCUMENTS 1,628,539 * 5/1927 Grey ..... 135/15.1
2,788,792 * 4/1957 Koller ..... 135/15.1
3,156,249 * 11/1964 Biderman ..... 135/15.1
5,640,984 * 6/1997 Dubunsky ..... 135/15.1
5,655,557 * 8/1997 Martin ..... 135/15.1

* cited by examiner

*Primary Examiner*—Alvin Chin-Shue
*Assistant Examiner*—Sarah Purol
(74) *Attorney, Agent, or Firm*—Gardere & Wynne, L.L.P.; Sanford E. Warren, Jr.

(57) ABSTRACT

An umbrella is disclosed that has a panel and a frame that has a shaft, an upper nest and a main runner movably mounted on the shaft. A plurality of main ribs having one end pivotally attached to the upper nest. A plurality of stretchers having one end pivotally attached to the main runner and the other end pivotally attached to the corresponding main rib to support the main rib. A secondary runner is movably mounted on the shaft between the upper nest and the main runner, and a plurality of secondary ribs, which are shorter than the main ribs, correspondingly have one end pivotally attached to the secondary runner and the other end attached to the free end of the corresponding main rib. Whereby the umbrella frame is strengthened enough to resist a strong wind.

3 Claims, 6 Drawing Sheets

UMBRELLA FRAME

BACKGROUND OF THE INVENTION

1. Field of the Invention

The present invention relates to an improved umbrella, especially to an umbrella frame that is strengthened by providing a secondary rib with each main rib of the frame, so that the umbrella frame will not invert as easily.

2. Description of Related Art

As shown in FIGS. 1 and 2, a typical conventional umbrella has a frame (10) and a panel (14) attached to the top of the frame (10). The frame (10) normally comprises a shaft (11), an upper nest (111), a runner (112), a plurality of ribs (12) and a plurality of stretchers (13).

The upper nest (111) is securely fixed on the top end of the shaft (11) by a cap (113) screwed onto the end of the shaft (11). The ribs (12) have one end pivotally attached to the upper nest (111). The stretchers (13) have one end pivotally attached to the runner (112) and the other end pivotally attached to the corresponding rib (12) by a joint positioned in the upper middle region of the rib (12). The runner (112) is movable along the shaft (11). To open the umbrella, a user pushes the runner (112) upward so the stretchers (13) extend the corresponding ribs (12) up and out to stretch the panel (14) on the ribs (12) of the frame (10).

However, since the structure of the frame (10) is relatively simple and the strength of the frame (10) is limited, the panel (14) of an opened conventional umbrella is easily blown into an inverted shape by a very strong wind, which will may result in damage to the ribs (12) of the frame (10).

SUMMARY OF THE INVENTION

The main object of the present invention is to provide a strengthened umbrella frame that has a secondary rib provided in conjunction with the normal main rib to strengthen the structure of the umbrella against the wind.

The features, benefits and advantages of the present invention will become apparent after a careful reading of the detailed description with appropriate reference to the accompanying drawings.

BRIFF DESCRIPTION OF THE DRAWINGS

DETAILED DESCRIPTION OF PRFERRED EMBODIMENT

Figure 1:
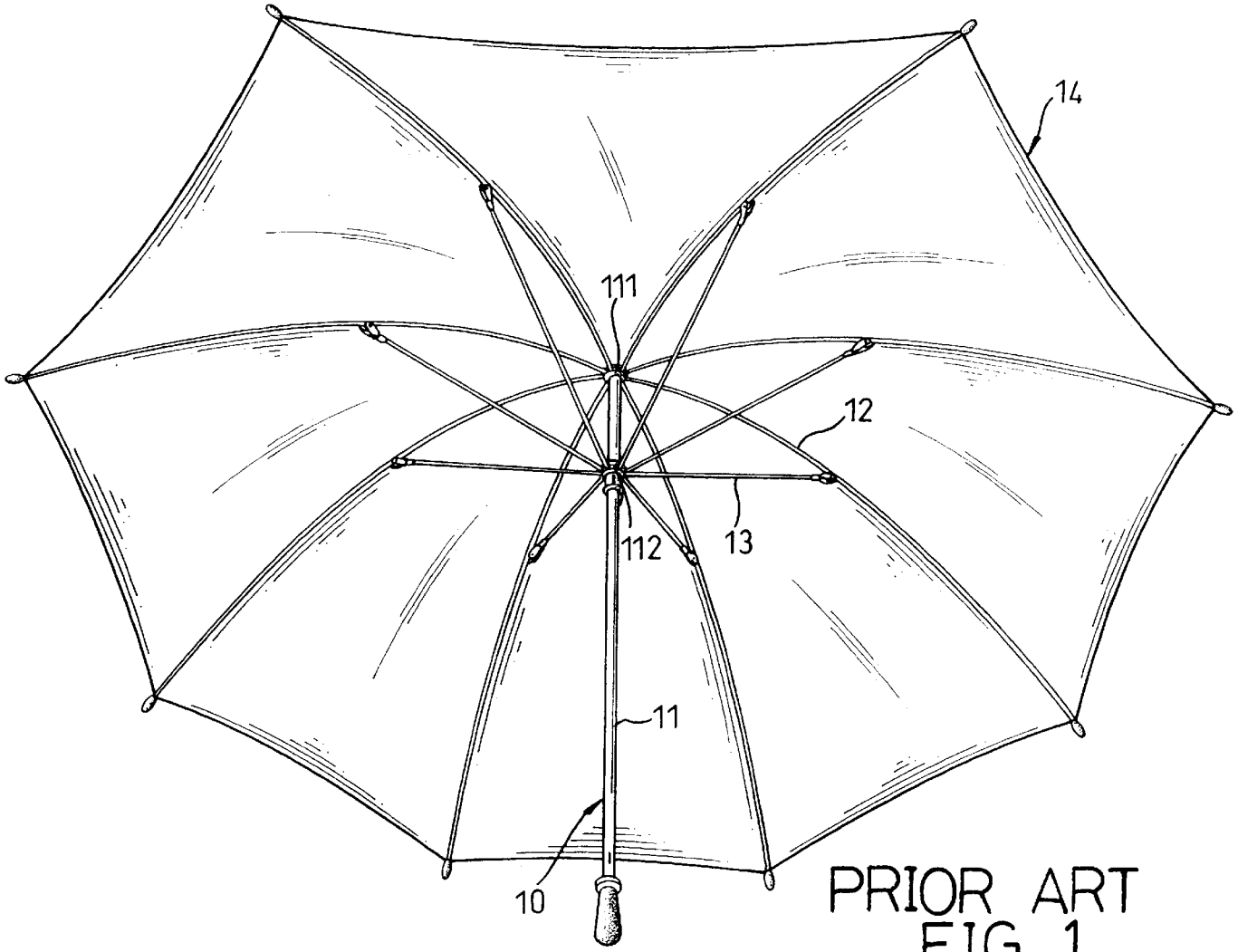
PRIOR ART FIG. 1
FIG. 1 is a perspective view of a conventional umbrella.
Figure 2:
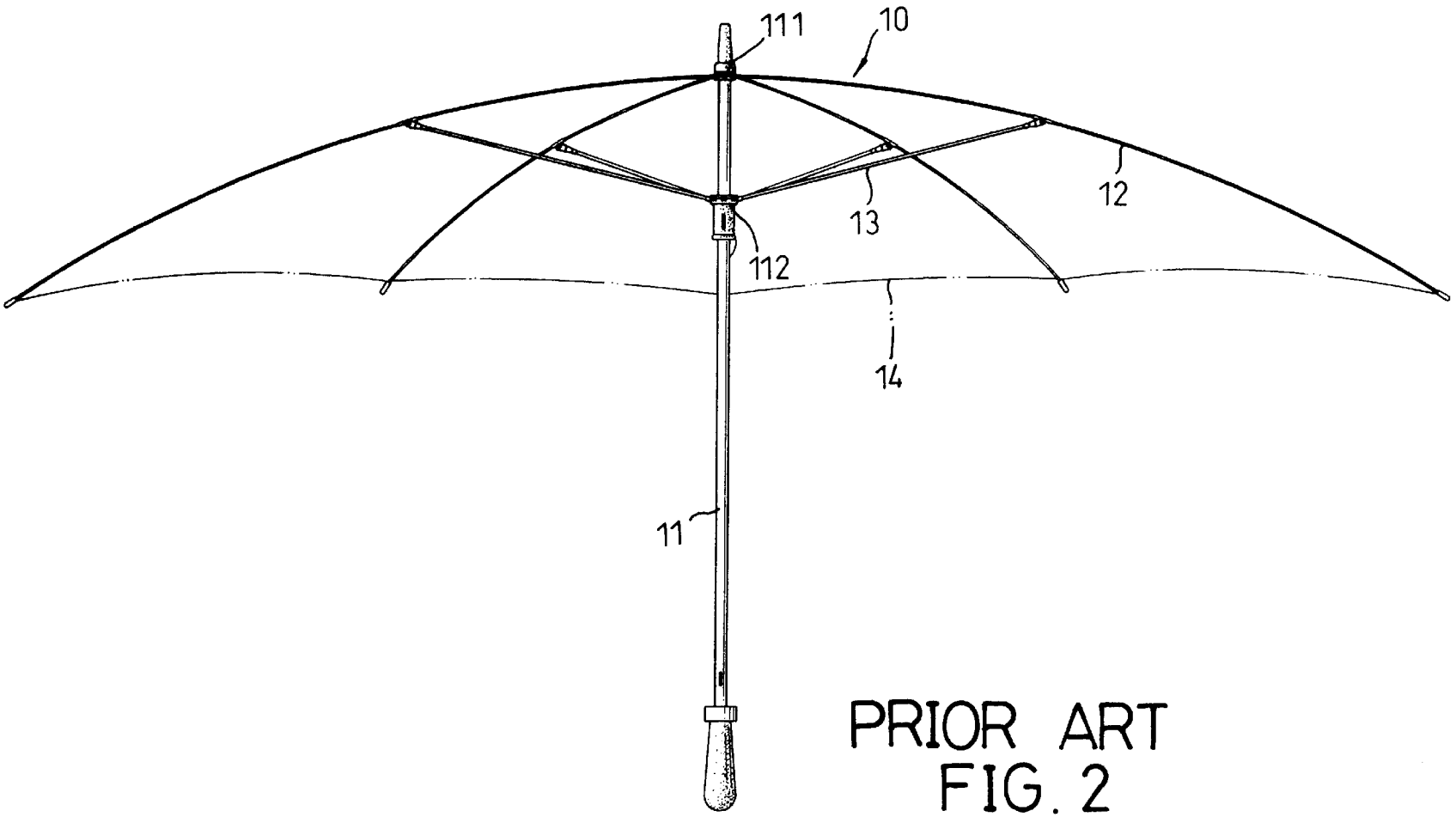
PRIOR ART FIG. 2
FIG. 2 is a side view of a conventional umbrella.
Figure 3:
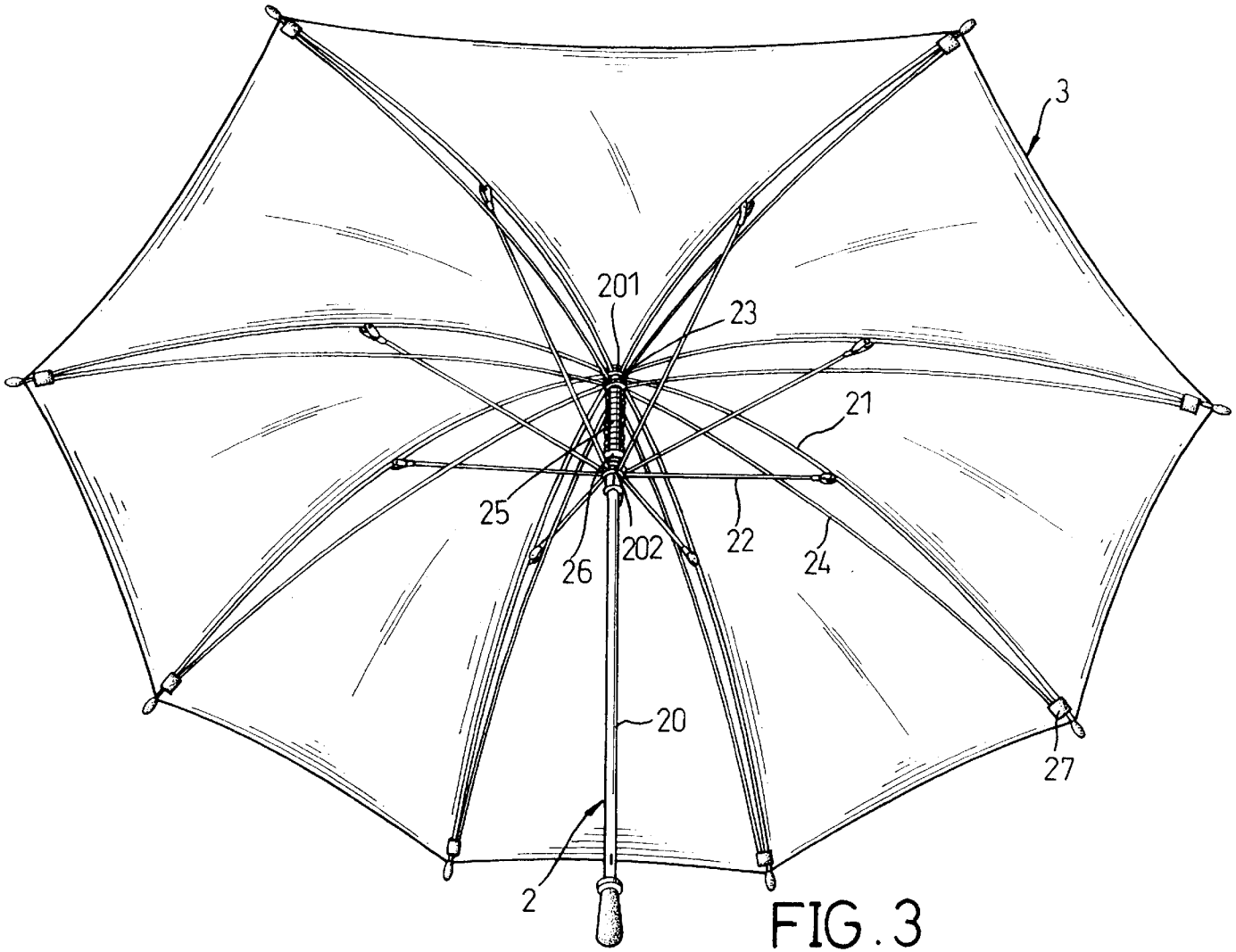
FIG. 3 is a perspective view of an umbrella in accordance with the present invention.

As shown in FIG. 3, an umbrella in accordance with the present invention comprises a frame (2) and a panel (3) attached to the top of the frame (2).

Figure 4:
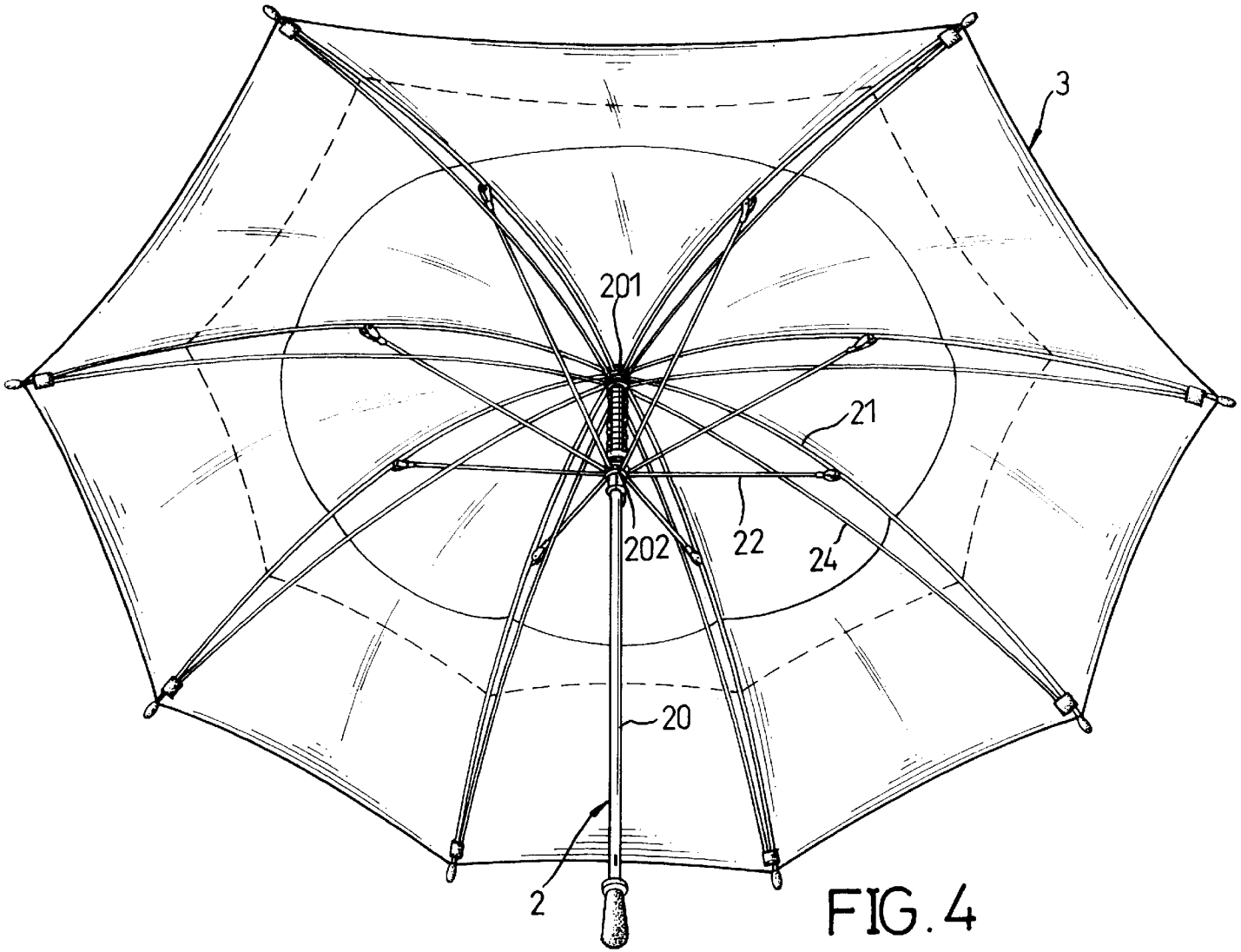
FIG. 4 is a perspective view of another embodiment of umbrella in accordance with the present invention.

The panel (3) may be a single piece of material as shown in FIG. 3, or a plurality of pieces with a ventilation piece covering an opening in a normal panel (3) as shown in FIG. 4.

Figure 5:
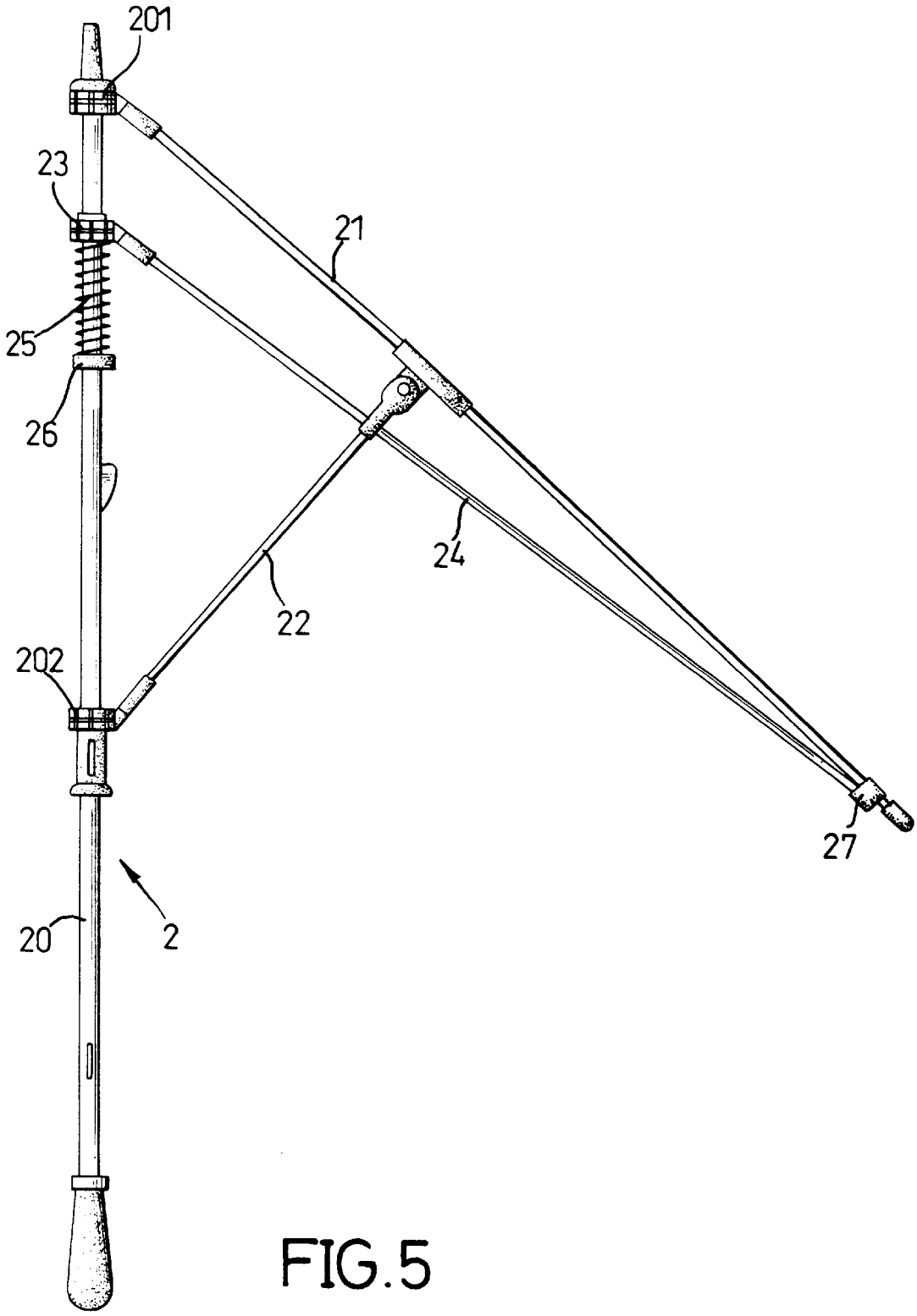
FIG. 5 is a partial side plan view of the umbrella in accordance with the present invention before being fully opened.

As can best be seen in FIGS. 3 to 5, the frame (2) comprises a shaft (20), an upper nest (201), a plurality of main ribs (21), a movable main runner (202) and a plurality of stretchers (22) corresponding to the main ribs (21). One end of each stretcher (22) is pivotally connected with the main runner (202) and the other end is securely attached to the corresponding main rib (21). A secondary runner (23) is movably mounted on the shaft (20) between the upper nest (201) and the main runner (202). A spring (25) has the upper end fixedly attached to the lower end of the secondary runner (23) and the lower end fixedly attached to a stop ring (26), so as that the spring (25) is able to provide a recovery force to the secondary runner (23) when forced to move toward the spring (25).

A plurality of secondary ribs (24) have one end pivotally attached to the secondary runner (23) and the other end attached to the free end of the corresponding main rib (21) by a sleeve (27). The length of the secondary rib (24) is slightly shorter than the main rib (21).

Figure 6:
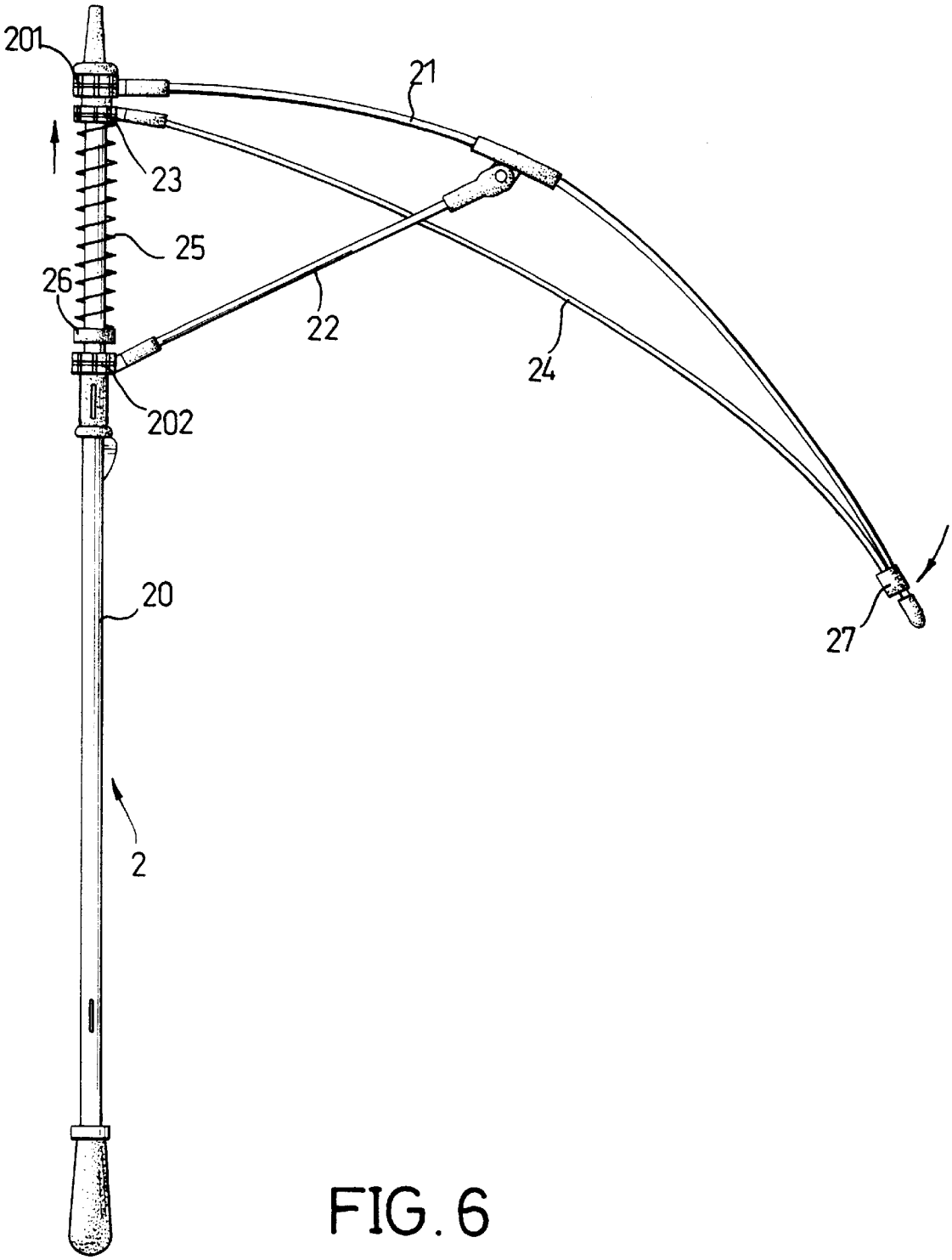
FIG. 6 is a partial side plan view of the umbrella in FIG. 5 fully opened.

When the umbrella frame (2) is opened by a user, the main runner (202) is moved upward so the stretchers (22) push the corresponding main rib (21) up. As the secondary ribs (24) are shorter than the main ribs (21), the distal ends of the main ribs (21) will be drawn inward as shown in FIG. 6. When the umbrella encounters a strong wind, the wind attempts to turn the panel (3) inside out. However, the secondary ribs (24) provide additional strength to the main ribs (21) against the wind, thus the main ribs (21) will not be turned inside out.

It should be clear to those skilled in the art that further embodiments may be made without departing from the scope of the present invention.

What is claimed is:

1. An umbrella including a panel (3) and a frame (2) which comprises a shaft (20) with an upper nest (201) mounted on the top end of the shaft (20); a main runner (202) movably mounted on the shaft (20); a plurality of main ribs (21) having one end pivotally attached to the upper nest (201); a plurality of stretchers (22) having one end pivotally attached to the main runner (202) and the other end pivotally attached to a corresponding main rib (21); wherein the improvements comprise:

a secondary runner (23) is movably mounted on the shaft (20) between the upper nest (201) and the main runner (202);

a plurality of secondary ribs (24) each have one end pivotally connected with the secondary runner (23) and the other end securely attached to the distal end of the corresponding main rib (21);

wherein the length of the secondary rib (24) is shorter than the corresponding main rib (21).

2. The umbrella as claimed in claim 1, wherein a sleeve (27) is provided at the joint of the main rib (21) and the secondary rib (24) to secure the connection therebetween.

3. The umbrella as claimed in claim 1, wherein a stop ring (26) is securely mounted on the shaft (20) and a spring (25) is mounted around the shaft (20) and between the secondary runner (23) and the stop ring (26);

whereby the spring (25) is able to provide a recovery force to the secondary runner (23) after the secondary runner (23) is forced to move toward the spring (25).

* * * * *